United States Patent [19]

Derimiggio et al.

[11] Patent Number: 4,905,050

[45] Date of Patent: Feb. 27, 1990

[54] FUSING APPARATUS HAVING AXIALLY UNSUPPORTED FUSER ROLLER

[75] Inventors: John E. Derimiggio, Fairport; Linn C. Hoover, Rochester, both of N.Y.

[73] Assignee: Eastman Kodak Company, Rochester, N.Y.

[21] Appl. No.: 290,787

[22] Filed: Dec. 28, 1988

[51] Int. Cl.[4] ..... G03G 15/20; H05B 3/10; H05B 1/00

[52] U.S. Cl. ..... 355/290; 219/216; 219/388; 219/469

[58] Field of Search ..... 219/216, 243, 244, 388, 219/469, 470; 355/282, 285, 286, 287, 288, 289, 290

[56] References Cited

U.S. PATENT DOCUMENTS

| | | | |
|---|---|---|---|
| 3,811,821 | 5/1974 | Ariyama et al. . | |
| 3,945,726 | 3/1976 | Ito et al. . | |
| 4,147,501 | 4/1979 | Goshima et al. | 355/282 |
| 4,192,229 | 3/1980 | Tsunoi et al. . | |
| 4,212,631 | 7/1980 | Franke et al. | 355/290 |
| 4,341,458 | 7/1982 | Glasa et al. | 355/290 |
| 4,420,680 | 12/1983 | Itoh | 219/216 X |
| 4,705,385 | 11/1987 | Palm et al. . | |

*Primary Examiner*—A. T. Grimley
*Assistant Examiner*—William J. Royer
*Attorney, Agent, or Firm*—Tallam I. Nguti

[57] ABSTRACT

An apparatus for fusing toner images to a receiver or copy sheet of paper includes a pressure roller and an axially unsupported fuser roller that is nested rotatably between the pressure roller and a pair of heater rollers. The apparatus of the present invention is particularly suitable for fusing toner images to the receiver or copy sheet without generating fuser related defects such as copy distortions, copy curls, wrinkles or image voids.

10 Claims, 2 Drawing Sheets

FUSING APPARATUS HAVING AXIALLY UNSUPPORTED FUSER ROLLER

RELATED APPLICATIONS

This application is related to U.S. patent application Ser. No. 07/290,799, filed on even date on Dec. 28, 1988 in the name of John E. Derimiggio, and entitled "FUSING APPARATUS WITH CORELESS FUSER ROLLER".

BACKGROUND OF THE INVENTION

This invention relates generally to fusing apparatus in electrostatographic copiers and printers for fusing toner images to suitable receivers or copy sheets of paper, and more particularly to such an apparatus that includes an axially unsupported fuser roller.

In electrostatographic copiers and printers, conventional heat and pressure fusing apparatus as disclosed, for example in U.S. Pat. No. 4,551,006, issued Nov. 5, 1985 in the name of Elvin, include a pair of rollers, each generally of a hollow metallic core that may be coated with a layer of compliant material such as an elastomer. Heat necessary for fusing is supplied to at least one of the rollers, usually the roller that directly contacts the toner images being fused. Such heat may be supplied by a heat source or lamp located within the hollow of the metallic core of such roller, or alternatively, by an external heat source that contacts and directly heats the surface of the one roller. Typically, the heated roller is the fused roller, while the other roller is the pressure roller. The pressure for fusing is supplied at the nip through cooperation between the fuser and pressure rollers. Whether heated internally or externally, such fuser and pressure rollers are conventionally axially supported to form a fusing nip through which the toner images are conveyed for fusing on a suitable receiver, or copy sheet of paper.

Axially supported rollers, however, may be expensive since they include axial mounting components such as gudgeons and bearings. In addition, axially supported rollers are not easy to service because the axial mounting components usually have to be disassembled during such service. Furthermore, axially supported rollers ordinarily rotate about a fixed axis, and hence are normally not capable of dissipating rotational strains and stresses that may cause fusing related defects such as copy sheet distortions, copy curls, wrinkles and image voids.

SUMMARY OF THE INVENTION

It is an object of the present invention to provide a fusing apparatus that effectively dissipates fusing related stresses and strains, and that thereby substantially prevents the occurrence of fusing related defects such as copy sheet distortions, copy curls, wrinkles and image voids.

Another object of the present invention is to provide a fusing apparatus that includes a fuser roller with fewer components, and that is easy to service.

According to the present invention, a fusing apparatus for fusing toner images to suitable receivers or copy sheets through the application of heat and pressure, includes a heater roller, at least one other roller, a pressure roller that is spaced from the heater roller and the other roller, and an axially unsupported fuser roller that is nested rotatably between the pressure roller, and the heater and other rollers. According to a preferred embodiment, the other roller is also a heater roller.

BRIEF DESCRIPTION OF THE DRAWINGS

In the detailed description of the preferred embodiment of the invention presented below, reference is made to the accompanying drawings in which.

DESCRIPTION OF THE PREFERRED EMBODIMENT

Figure 1:
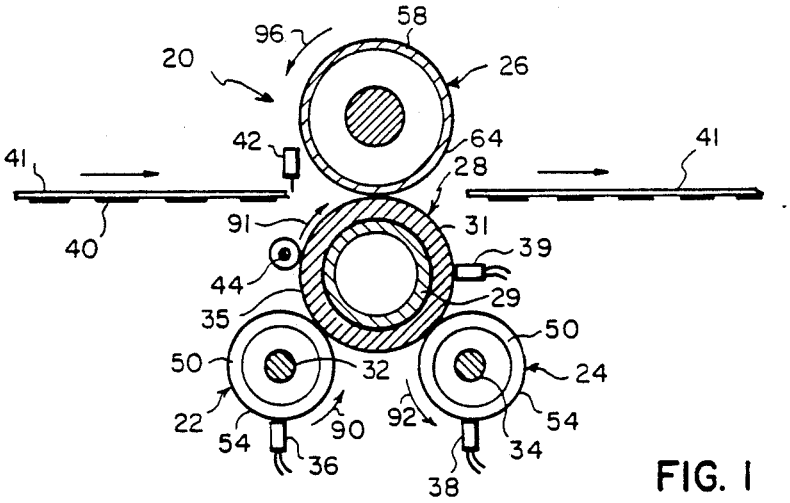
FIG. 1 is a schematic elevational view of the fusing apparatus of the present invention showing a fuser roller nested, axially unsupported on a pair of heater rollers.

Referring now to FIG. 1, an apparatus suitable for fusing toner images in an electrostatographic copier or printer is generally designated 20, and includes a pair of heater rollers 22, 24, a pressure roller 26, and a fuser roller 28.

The fuser roller 28, like conventional fuser rollers, has a hollow cylindrical core 29 made of a heat-conductive material such as aluminum. The core 29 is coated on the outside with a compliant, resilient material 31, for example, silicone rubber, and includes a smooth surface 35 suitable for making contact with toner images. Unlike conventional fuser rollers, however, fuser roller 28 has no axial mounting components such as grudgeons and bearings. Instead, fuser roller 28 is simply nested, axially unsupported, in a stacked arrangement, on the heater rollers 22, 24, and below the pressure roller 26. Nested as such, the fuser roller 28 forms a fusing nip 30 with the pressure roller 26 through which toner images 40 on substrates or copy sheets of paper 41, can be fused. In addition, fuser roller 28 is in frictional and rotational engagement with each of the heater rollers 22, 24.

As illustrated in FIG. 1, heater rollers 22, 24 may each consist of a hollow core 50 that has a hard anodized surface coating 54. The core 50 is usually metallic, for example, aluminum. Heat sources 32, 34, which can be quartz lamps, are located within the core 50 for internally heating each of the rollers 22,24. As shown in FIG. 1, the temperatures of the rollers 22, 24 can be sensed and controlled respectively through first and second temperature control sensors 36, 38. On the other hand, the temperature of the surface 35 of the fuser roller 28, can be sensed and controlled through a third temperature control sensor 39.

Figure 4:
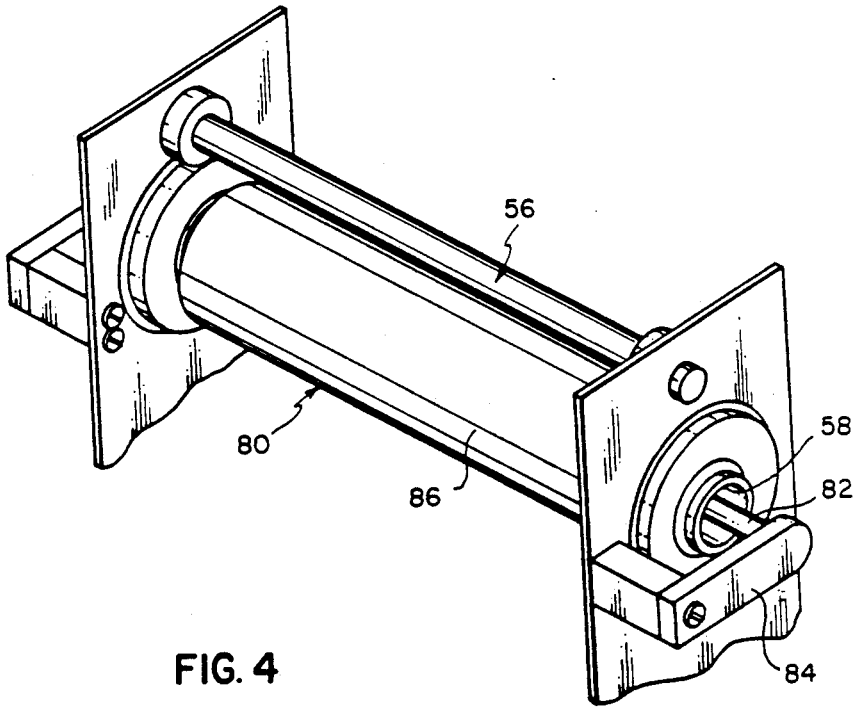
FIG. 4 is a perspective illustration of a pressure roller for use in a duplex mode of the present invention.

The pressure roller 26, which forms the fusing nip 30 with the fuser roller 28, may consist of a hollow metallic core 58 that has, for example, a Silverstone surface coating 64. (Silverstone is a tradename of the Du Pont Co.). A shaft 60 is located within the core 58 for supporting the roller 26 within the apparatus 20. For producing one-sided or simplex copies, the pressure roller 26 is normally unheated. However, for producing two-sided or duplex copies, a heated pressure roller 80 as shown in FIG. 4, is used in place of the unheated roller 26. Unlike the roller 26, roller 80 has located within the hollow of its core 58, a heat source 82 that is supported by means 84. Because roller 80 in the duplex mode will directly contact the toner images 40 (FIG. 1), it additionally should include an elastomeric coating 86 over the core 58, in a manner comparable to that of conventional fuser rollers. In either mode, however, the pressure roller 26 or 80 includes means such as a cam 56 for moving it against the fuser roller 28.

Cam means 56 may be connected to a drive means (not shown), and is selectively drivable to move the pressure roller 26 against the fuser roller 28. As illustrated, cam means 56 may include an elongate shaft 66 and two cam members 68, 69 connected eccentrically at each end of the shaft. The connections of the cam members are such that a complete revolution of the cam members is sufficient to move the pressure roller 26 against the fuser roller 28 for applying pressure over the length of a copy sheet 41 as it is being fed through the fusing nip 30. The pressure roller 26 and cam 56 are supported at each end by a support frame 78 that includes an end plate 79 attached to it for supporting the heat sources 32, 34.

Figure 2:
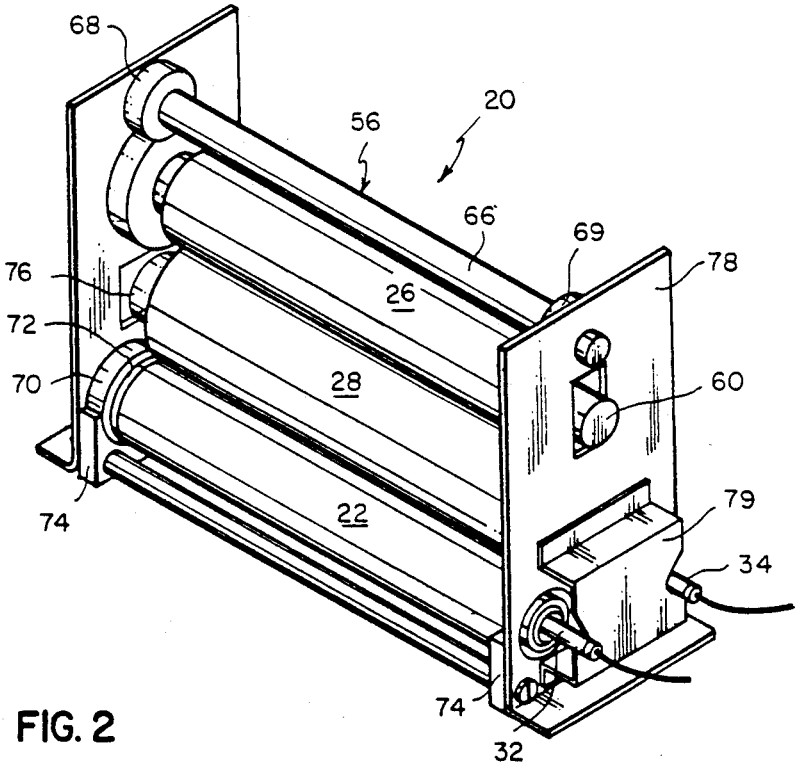
FIG. 2 is a perspective view of the fusing apparatus of the present invention.

As illustrated in FIG. 2, each heater roller 22, 24 is fitted with a pair of cylindrical end bearings 70. Each bearing 70 has a diameter greater than that of the heater rollers 22, 24, thereby forming a flange 72 at each end of each heater roller. As mounted, the rollers 22, 24 are spaced side by side on a pair of bearing blocks 74, with the bearings 70 being supported directly by, and for rotation on, the blocks 74. For proper nesting of the axially unsupported fuser roller 28 on the rollers 22, 24, the side by side spacing between the rollers 22, 24 as mounted, has to be less than the diameter of the fuser roller 28. When properly nested axially unsupported as such, the axial position of the fuser roller 28 relative to the heater rollers 22, 24, and pressure 26, is maintained through point contact between the end plates 79 and an end cap 76 at each end of the fuser roller. The end caps 76 can be made, for example, of a high temperature plastic.

Although the fuser roller 28 is assembled axially unsupported in the apparatus 20, it is substantially free of any tendency to bend or deflect because the stiffness or deflectability, about it, of the heater rollers 22,24, and pressure roller 26, is equalized. Such bending or deflection of the fuser roller 28 is substantially prevented by selecting the sizes of, and the materials for the rollers, such that the heater rollers 22, 24, and pressure roller 26, have equal and complimentary stiffness or deflectability about the fuser roller 28.

Figure 3:
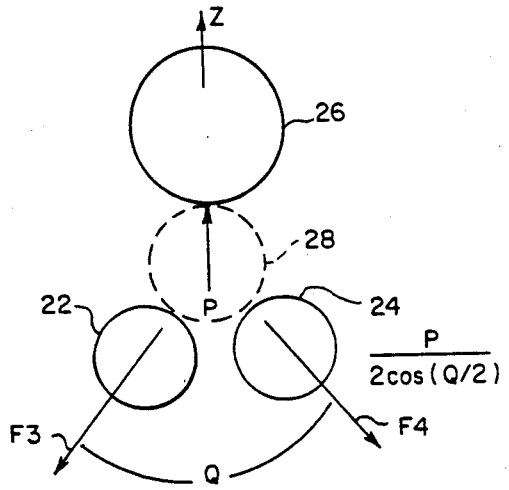
FIG. 3 is a schematic of the present invention illustrating forces acting on the various rollers.

The stiffness or deflectability of the pressure roller about the fuser roller, for example, can be determined according to the formula $d=CF/E_1I_1$;

where $d$=deflection $C$=constant $F$=force applied to the pressure roller $E_1$=Young's modulus of the material of such roller $I_1$=Area moment of inertia of roller Referring now to FIG. 3, a schematic of the fusing apparatus of the present invention is shown in which the heater rollers 22, 24 form an angle Q with the axis of the fuser roller 28. It is assumed that from a pressure roller 26 of given size and material, it is known that such a pressure roller has an area moment of inertia $I_1$, and is made of a material that has a known Young's modulus $E_1$. Furthermore, it is known that a force $F_1$ of magnitude P acts in the Z-direction on the pressure roller 26. As such, forces $F_3$ and $F_4$, each of magnitude $P/2 \cos (Q/2)$ act respectively, as shown, on heater rollers 22, 24. From the above known and given facts, the material for, and size of, the heater rollers 22, 24 can be determined by equating the deflection $CP/E_1I_1$ of the pressure roller 26 in the Z-direction, to the resultant deflection $CP \cos (Q/2)/[2 \cos (Q/2)E_2]$ of the heater rollers, also in the Z-direction, where $E_2$ and $I_2$ represent Young's modulus and area moment of inertia of each heater roller.

Solving the equation $CP/E_1I_1=CP \cos (Q/2)/[2 \cos (Q/2)E_2I_2]$, yields the result $E_1I_1=2E_2I_2$. In other words, in the particular configuration illustrated and preferred for the apparatus 20 of the present invention, $E_2I_2=\frac{1}{2}E_1I_1$. Accordingly therefore, the material and size of each heater roller 22, 24 can then be selected so that this product ratio (of the area moment of inertia and Young's modulus) between the pressure and heater rollers, is satisfied. Doing so will insure that the stiffness of the rollers 22, 24 and 26, about the fuser roller 28, are equalized, for example, in the Z-direction. Equalizing the stiffness of the rollers 22, 24 and 26, as such, should effectively prevent any tendency by the fuser roller 28 to bend any where along its longitudinal axis.

For driving the fuser roller 28, one of the heater rollers 22 or 24 may be connected to drive means (not shown) for frictionally moving the fuser roller 28 in the direction of the arrow 91. As illustrated in FIG. 1, the rest of the heater rollers, the fuser roller 28 and pressure roller 26 can be equally driven frictionally in the directions of the arrows 90, 91, 92, and 96, by connecting one of the heater rollers 22 or 24 to such drive means.

In the stacked arrangement of the apparatus 20, the fuser roller 28 can be serviced easily, simply by first loosening the pressure roller 26 or one of the heater rollers 22 or 24, and then sliding out the fuser roller. In such an arrangement, the axially unsupported fuser roller 28, because it does not include axial mounting components such as gudgeons and bearings, is relatively less expensive than if axially supported. Most importantly, because the fuser roller 28 is axially unsupported, it is capable of adjusting and responding freely to fusing related strains and stresses, and thereby capable of dissipating such strains and stresses along, and about, its longitudinal axis. Such dissipation substantially eliminates possible copy sheet distortion, as well as, such fusing related defects as copy curls, wrinkles and image voids.

Although the present invention has been described in detail with particular reference to a preferred embodiment, it will be understood that variations and modifications can be effected within its scope and spirit.

What is claimed is:

1. An apparatus for fusing toner particles to a receiver such as a copy sheet through the application of heat and pressure, the apparatus including:

(a) a heater roller;

(b) at least one other roller;

(c) a pressure roller, spaced from said heater roller and said other roller;

(d) means for supporting said pressure, heater and other rollers; and (e) an axially unsupported fuser roller nested rotatably between said heater, pressure and other rollers.

2. The invention as set forth in claim 1 wherein said other roller is also a heater roller and said rollers are positioned in a stacked arrangement.

3. The invention as set forth in claim 1 wherein at least one of said heater roller, or other rollers is connected to drive means and frictionally engages and drives said fuser roller.

4. The invention as set forth in claim 2 wherein in the stacked arrangement of said heater, pressure and fuser rollers, one of said heater rollers or said pressure roller is connected to a drive means and frictionally drives all the other rollers.

5. The invention as set forth in claim 2 wherein the materials and size of said pressure roller, and of said heater rollers, are selected so as to equalize their deflectability or stiffness about said fuser roller.

6. The invention as set forth in claim 1 further including means for maintaining the axial position of said fuser roller relative to said heater rollers and said pressure roller.

7. The invention as set forth in claim 1 further including:

(a) pressure applying cams mounted to ride on each end of said pressure roller for moving said pressure roller against said fuser roller, thereby forming a fusing nip through which the receivers or copy sheets are conveyed.

8. The invention as set forth in claim 2 wherein said heater rollers are supported spaced side by side at a distance that is less than the diameter of said fuser roller.

9. The invention as set forth in claim 6 wherein said means for maintaining the axial position of said fuser roller includes an end cap attached to each end of said fuser roller for making point contact with, and for spacing said fuser roller between, a pair of end plates connected to said supporting means.

10. The invention as set forth in claim 9 wherein each said end cap is conical.

* * * * *